US006828530B2

(12) United States Patent
Boegel et al.

(10) Patent No.: US 6,828,530 B2
(45) Date of Patent: Dec. 7, 2004

(54) APPARATUS FOR MARKING THE OPERATION OF AN INDUCTION COIL BY ILLUMINATION

(75) Inventors: Joerg Boegel, Oberderdingen (DE); Michael Stoeffler, Maulbronn (DE); Wilfried Schilling, Kraichtal (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 6 days.

(21) Appl. No.: 10/303,074

(22) Filed: Nov. 25, 2002

(65) Prior Publication Data

US 2003/0111460 A1 Jun. 19, 2003

(30) Foreign Application Priority Data

Nov. 30, 2001 (DE) ..... 101 59 682

(51) Int. Cl.[7] ..... H05B 6/12

(52) U.S. Cl. ..... 219/620; 219/622; 219/665; 219/506; 362/92; 362/555

(58) Field of Search ..... 219/620, 622, 219/623, 624, 647, 649, 665, 720, 506; 362/92, 555, 581; 99/DIG. 14, 325

(56) References Cited

U.S. PATENT DOCUMENTS 5,655,830 A * 8/1997 Ruskouski ..... 362/240
6,144,019 A 11/2000 Garcia et al. ..... 219/624
6,288,374 B1 * 9/2001 Eskildsen et al. ..... 219/621
2003/0057200 A1 3/2003 Ogata et al.

FOREIGN PATENT DOCUMENTS

| | | | |
|---|---|---|---|
| DE | 195 46 853 | 6/1997 | |
| DE | 198 45 844 | 4/2000 | |
| DE | 199 50 388 | 4/2001 | |
| JP | 03-289084 | * 12/1991 | ..... 219/622 |
| JP | 07-312279 | * 11/1995 | |
| WO | WO 01/41510 | 6/2001 | |
| WO | WO 01/52603 | 7/2001 | |

* cited by examiner

*Primary Examiner*—Philip H. Leung
(74) *Attorney, Agent, or Firm*—Nath & Associates PLLC; Marvin C. Berkowitz; Derek Richmond

(57) ABSTRACT

An illuminating apparatus for an induction coil of an induction cooking field is in the form of a ⅓ circular ring segment and carries conducting tracks, which form turns of a coil, which is connected to several LEDs. During induction coil operation an alternating voltage is induced in the coil and consequently the LEDs are supplied. With such an illuminating apparatus it is possible without additional wiring expenditure to illuminate an induction coil under a glass ceramic cooking field.

18 Claims, 1 Drawing Sheet

APPARATUS FOR MARKING THE OPERATION OF AN INDUCTION COIL BY ILLUMINATION

FIELD OF APPLICATION AND PRIOR ART

The invention relates to an apparatus for marking the operation and/or the position of an induction coil of an inductive cooking field by illumination or illuminated marking. Furthermore, the invention relates to an inductive heating device with such an apparatus.

Induction coils of an inductive cooking field can be located beneath a glass ceramic plate on which is placed a corresponding saucepan. Below this plate is located the induction coil and transmits energy into the bottom of the saucepan for heating purposes.

Such as is e.g. the case with radiant heaters, in many cases it is here desirable to have an optical indication of the operation or position of the heating in the vicinity of the latter. It is possible to place beneath an induction coil illumination means and by means of laterally extracted light guides to mark the induction coil by illumination. However, the electrical connection of the illumination means is complicated. As a result of the location below the induction coil there is an increase in the overall height, which is considered disadvantageous.

PROBLEM AND SOLUTION

The problem of the invention is to provide an apparatus of the aforementioned type and an inductive heating device with which the disadvantages of the prior art are avoided and where in particular an illuminated marking of an induction coil, its operation or its position is possible in a very simple and operationally reliable manner.

This problem is solved by an apparatus having an electric illumination means and a transformatory receiving coil for placing in a magnetic field of an induction coil, the receiving coil being connected to the illumination means, and an inductive heating device. Advantageous and preferred developments of the invention are described in greater detail hereinafter. In the sense of this application the term "comprise" is not to be understood restrictively as "only comprising the same", but instead as "having inter alia".

According to the invention said apparatus has a support having or supporting at least one electrical illumination means. The apparatus has a receiving coil, which can be placed in the magnetic field of the induction coil and permits a transformatory energy transmission from the induction coil to the receiving coil. The receiving coil is in turn connected to the illumination means and supplies the latter with energy from the induction coil.

This offers the major advantage that there is no need for electrical connections between an apparatus according to the invention and a power supply, to which is e.g. also connected the induction coil. Thus, there is an energy transmission without direct connection or contact. With a single induction coil several supports or receiving coils around the same can be supplied. In this way an apparatus according to the invention can be manufactured and installed as a relatively autarchic functional and constructional unit. Installation essentially consists of fixing.

In order to consume minimum energy, LEDs are advantageously used as the illumination means. Particular advantage is gained through LEDs, which are heat-resistant up to at least 100ø C. In this way operation under a glass ceramic cooking field is in most cases easily possible without excess temperature problems. Through the alternative use of glow lamps, excess temperature problems can be completely avoided.

For each receiving coil it is possible to provide several illumination means, the receiving coil advantageously being correspondingly dimensioned in each case. As stated, the illumination means can be LEDs. This has the advantage that they can be connected in oppositely poled manner to the receiving coil in in each case roughly the same number. Thus, in the case of the LEDs both positive and negative phases of the voltage generated in the receiving coil are used.

In a preferred development of the invention the receiving coil is located on the support together with the illumination means. For this purpose the support can be constituted by a printed circuit board. This offers the possibility of constructing the receiving coil in a particularly advantageous manner from the production standpoint through conducting tracks made on the printed circuit board. As high currents do not flow in the receiving coil, said conducting tracks or the turns of the receiving coil can be made very thin and can therefore be relatively closely juxtaposed. Advantageously the receiving coil or its turns can pass or pass round in the outer area of the support, so that in the middle there remains space for the illumination means or further devices. The receiving coil can pass spirally over the support. In order to increase the number of turns per support, the receiving coil can be located on both sides of the support, e.g. in a mutually corresponding manner. These two parts can then be connected.

In the case of a direct connection of the illumination means to the receiving coil, it is possible to obtain the brightness of the illumination means in a manner roughly dependent on the power of the induction coil. This provides additional information on the operating state of the induction coil.

According to another development of the invention a substantially power-independent lighting or illumination can be obtained by providing voltage limiting means for the illumination means. To minimize brightness fluctuations, upstream of the LEDs can be connected series resistors. They are preferably placed on the same support as the illumination means in each case connected thereto. In particularly preferred manner they are located close to the illumination means.

For the case that in conventional manner an induction coil has a flat, circular construction, the support can have an essentially circular ring sector shape. This means that one or more supports together can surround the induction coil. According to one possibility such a circular ring sector can extend over an angular range of approximately 120ø. Thus, with three such supports it is possible to border the induction coil. The radius of a support with circular ring sector shape can be chosen in such a way that the support is in accordance with the induction coil shape and has a specific spacing therefrom. This spacing can be a few millimeters to a few centimeters, e.g. 10 to 20 mm. Here spacing is understood to mean the spacing between the induction coil and the receiving coil.

It is possible by lighting means to mark an induction coil, which as a rule gives a roughly punctiform illumination. According to a further development of the invention light distribution means can be associated with the at least one illumination means and by means thereof it is possible to bring about a larger or elongated or even areally distributed light phenomenon. Such light distributing means are known from other fields of application, e.g. as lighting tracks. The light distributing means can be placed over one or more illumination means. They are preferably made from a transparent plastic. Their path generally corresponds to the desired path of a lighting means. Their path in particular roughly corresponds to the shape of an induction coil and e.g. forms an illuminating circular ring surrounding the same.

In order to avoid thermal problems, above the apparatus can be provided a thermal insulation, which is translucent at least in the vicinity of the illumination means. Such an insulation can e.g. be connected to the support by means of a holder or spacer, so as to form a constructional unit. From the surface the insulation at least covers and better still projects over the top of the apparatus. It is in this way possible in the case of particularly strongly heated saucepan bottoms, which have become laterally displaced and are located above the apparatus or illumination means, to prevent overheating of the illumination means or the apparatus or the receiving coil. Thus, the thermal insulation is intended to shield the apparatus up to the cover or cooking field. The insulation can e.g. be glass or a heat-resistant plastic, which should be provided with a corresponding coating. For this purpose are particularly suitable IR-reflecting coatings.

In particularly advantageous manner an apparatus according to the invention is independent of the construction of an induction coil. It is possible in this way to construct an apparatus for the retrofitting of a random induction coil or random induction cooking point.

In addition, the aforementioned set problem is advantageously solved by an inductive heating device. With such an inventive, inductive heating device, which can in particular be an induction cooking field, close to the induction coil is provided at least one of the aforementioned devices or supports.

In a preferred development of the invention an induction coil is substantially surrounded by illumination means on one or more supports. It is advantageous if the illumination means have a substantially identical lateral spacing, e.g. a few centimeters, with respect to the induction coil. For marking and in particular accentuating the circular shape of the induction coil there should be at least four and advantageously far more illumination means. Thus, a punctiform or, by means of the aforementioned light distributing means, a strip-like lighting image can be created around the induction coil.

If the supports of the apparatuses are circular ring sectors, e.g. ⅓ circular ring sectors, a fitting thereof is easily possible. This can e.g. be such that the induction coil, particularly with several induction coils together, is secured to a base holder and at least one support is fixed to the latter. Fixing can e.g. take place by adhesion, particularly using two-sided foam adhesive strips.

BRIEF DESCRIPTION OF THE DRAWINGS

Embodiments of the invention are diagrammatically illustrated in the drawings and are explained hereinafter. In the drawings show.

DETAILED DESCRIPTION OF EMBODIMENTS

Figure 1:
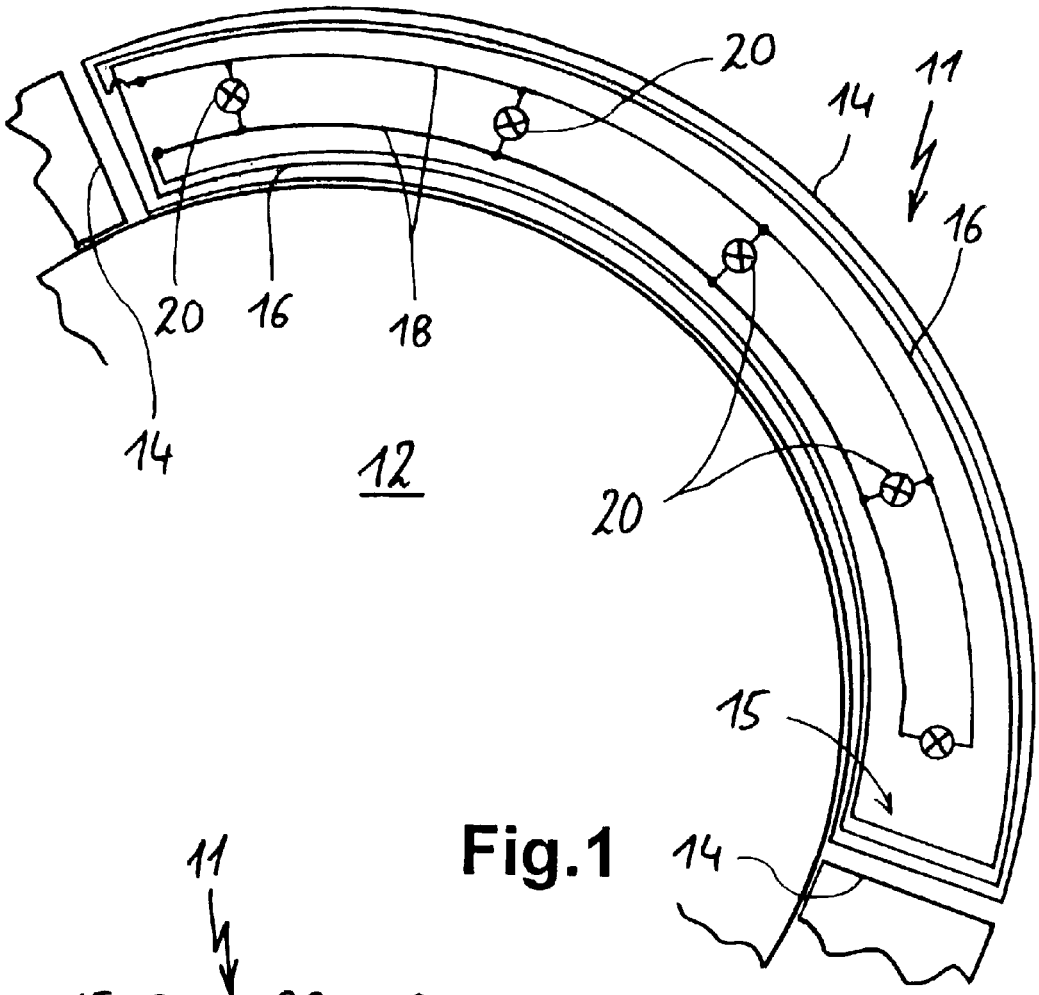
FIG. 1 A plan view of an inventive illuminating apparatus on a circular segment printed circuit board.

FIG. 1 shows a possible construction of an illuminating apparatus 11, which has a circular ring sector shape and in this case a third of a circle. The illuminating apparatus 11 is positioned at a limited distance from the outer edge of an induction coil 12. As shown, to the left and right are connected to the lighting apparatus 11 preferably identically constructed, further lighting apparatuses, so as to form a complete circle around the induction coil 12.

The illuminating apparatus 11 comprises a printed circuit board 14. On the latter is applied the coil 15 in the form whereby the circumferential coil turns 16 are formed by corresponding conducting tracks. A coil 15 with two turns 16 is shown to facilitate viewing. In practice more turns are preferred, e.g. seven or eight. As can be seen in the left-hand, upper area of the printed circuit board 14, a track overlap is necessary. This is diagrammatically illustrated by a bridge. In practice this can be brought about by a separate component to be soldered on.

Particular advantage is obtained with a possibility in which both surfaces of the printed circuit board 14 carry a coil 15 with turns 16 and are connected by an electrical connection passing through the board 15. This avoids the problem of such overlaps. By series connection of the two coils it is possible to increase the induced voltage or reduce the number of turns per printed circuit board surface.

Generally the induction coils 12 are applied, e.g. firmly bonded to a sheet aluminium support. In this way the illuminating apparatus 11 can also be fixed to the same sheet aluminium support.

By means of connecting lines 18, the LEDs 20 are connected to the coil 15. These connections 18 are also constructed as conducting tracks on the printed circuit board 14. The LEDs 20 can be correspondingly soldered to the printed circuit board 14. It is possible to use SMD components or LEDs, which can be applied using automatic insertion machines.

As can be seen in FIG. 1, the LEDs 20 are connected parallel to one another to the coil 15. If there are turns 16 on the front and back of the printed circuit board 14 and therefore two coils 15 are formed, said coils are advantageously connected in series.

Figure 2:
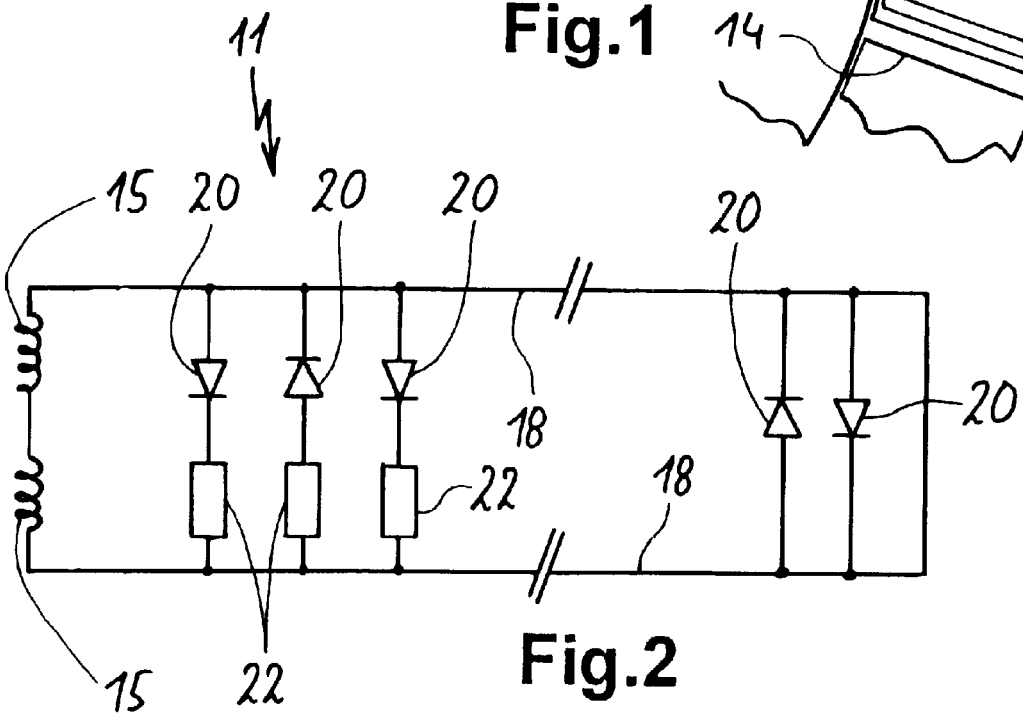
FIG. 2 An electric circuit diagram thereof.

This is also visible in FIG. 2 showing two coils 15 in series. They are once again connected by connecting lines 18 to a plurality of parallel-connected LEDs 20. For reasons of simplicity, FIG. 2 shows in a joint representation both a construction with a single LED 20 and also with series resistors 22 in each LED branch. The series resistors 22 bring about a reduction to brightness fluctuations. The series resistors 22 are advantageously located close to the LED 20 on the printed circuit board 14. This is more particularly possible when using SMD components, because the latter are very small. Series resistors also have the important advantage that an overload protection is provided. It is also possible to use other voltage limiting means.

As can be seen in FIG. 2, the LEDs 20 can in each case be connected in alternately poled manner. Therefore with LEDs both positive and negative half-waves of the alternating voltage induced in the coils 15 can be used.

A possible thermal insulation is not shown in the drawings. This advantageously roughly has the shape of the printed circuit boards 14 or can be somewhat larger and is fixed above the same by spacers. However, this can be easily implemented by the expert.

As can be seen in FIG. 1, such illuminating apparatuses can also be subsequently fitted to the induction coils 12 of an induction cooking point. Through varying the radius of the circular ring segment illuminating apparatus 11, it is easily possible to bring about an adaptation to different diameters of induction coils 12. It is particularly advantageous that there is no connection effort and cost for the power supply of the illumination means 20.

What is claimed is:

1. Apparatus for marking the operation or position of an induction coil by illumination, said induction coil has a magnetic field and is part of an inductive cooking field, wherein said apparatus has a support and said support has at least one electric illumination means, said apparatus further having a transformatory receiving coil for placing in said magnetic field of said induction coil, and said receiving coil is connected to said illumination means said receiving coil being located on said support together with said illumination means wherein said induction coil is flat and circular, said support having essentially a circular ring sector-shape, and wherein the radius of said circular ring sector-shaped support is such that several of said supports, in accordance with the shape of said induction coil, are to be positioned with a specific spacing of 1 to 5 cm from said induction coil and surround said induction coil.

2. Apparatus according to claim 1, wherein there are several of said illumination means per one said receiving coil, and wherein said illumination means are LEDs and are connected in alternately oppositely poled manner to said receiving coil.

3. Apparatus according to claim 1, wherein said receiving coil is located on said support, said support being a printed circuit board, and wherein said receiving coil has conducting tracks, conducting tracks being applied to said printed circuit board.

4. Apparatus according to claim 3, wherein said receiving coil passes round near to an outer rim of said support and is located on both sides of said support.

5. Apparatus according to claim 4, wherein said support is substantially flat and thin with two surfaces, said receiving coil being located on both said surfaces of said support.

6. Apparatus according to claim 1, wherein there are voltage limiting means provided for said illumination means, said voltage limiting means being constituted by series resistors for said illumination means.

7. Apparatus according to claim 6, wherein said voltage limiting means are located on said support as said illumination means, wherein they are located in the vicinity of said illumination means.

8. Apparatus according to claim 1, wherein light distributing means are associated with said at least one illumination means for producing an elongated distributed light phenomenon from the light of an at least substantially punctiform light source.

9. Apparatus according to claim 8, wherein said light distributing means are located over at least one said light source and are made from transparent plastic.

10. Apparatus according to claim 8, wherein the path of said light distributing means as a light phenomenon roughly corresponds to said shape of said induction coil.

11. Apparatus according to claim 1, wherein it is situated underneath a translucent, thermal insulation.

12. Apparatus according to claim 1, wherein it is constructed for the retrofitting of a random induction coil.

13. Inductive heating device with an induction coil and a cover positioned above said induction coil, wherein an apparatus for marking the operation or position of said induction coil by illumination is positioned close to said induction coil said induction coil has a magnetic field and is part of an inductive cooking field, wherein said apparatus has a support and said support has at least one electric illumination means, said apparatus further having a transformatory receiving coil for placing in said magnetic field of said induction coil, and said receiving coil is connected to said illumination means, said receiving coil being located on said support together with said illumination means, wherein said induction coil is flat and circular, said support having essentially a circular ring sector-shape, wherein the radius of said circular ring sector-shaped support is such that several of said supports, in accordance with the shape of said induction coil, are to be positioned with a specific spacing of 1 to 5 cm from said induction coil and surround said induction coil.

14. Inductive heating device according to claim 13, wherein one or more supports substantially surround said induction coil with a spacing of a few centimeters, and wherein there are at least four illumination means per induction coil.

15. Inductive heating device according to claim 13, wherein a translucent, thermal insulation is provided between one said support and said cover and shields said support completely at least up to said cover.

16. Inductive heating device according to claim 15, wherein said thermal insulation is provided with an IR-reflecting coating.

17. Inductive heating device according to claim 16, wherein said coating is of glass.

18. Inductive heating device according to claim 13, wherein said induction coil is fixed to a base holder and said at least one support is fixed to said same base holder.

* * * * *

UNITED STATES PATENT AND TRADEMARK OFFICE

CERTIFICATE OF CORRECTION

PATENT NO. : 6,828,530 B2
DATED : December 7, 2004
INVENTOR(S) : Boegel et al.

It is certified that error appears in the above-identified patent and that said Letters Patent is hereby corrected as shown below:

Column 6,
Line 17, please delete “coil said” and replace with -- coil, said --

Signed and Sealed this

First Day of March, 2005

JON W. DUDAS
*Director of the United States Patent and Trademark Office*